US006428058B1

(12) United States Patent
Graute

(10) Patent No.: US 6,428,058 B1
(45) Date of Patent: Aug. 6, 2002

(54) MOTOR-VEHICLE DOOR LATCH

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 1 days.

(21) Appl. No.: 09/716,925

(22) Filed: Nov. 20, 2000

(30) Foreign Application Priority Data

Nov. 20, 1999 (DE) ..... 199 55 882

(51) Int. Cl.[7] ..... E05C 3/06; E05C 3/16

(52) U.S. Cl. ..... 292/216; 292/201; 292/DIG. 23; 292/DIG. 24; 292/DIG. 61

(58) Field of Search ..... 242/216, 201, 242/DIG. 23, DIG. 24, DIG. 61

(56) References Cited

U.S. PATENT DOCUMENTS

| | | | | | |
|---|---|---|---|---|---|
| 3,365,226 | A | * | 1/1968 | Shay | 292/201 |
| 3,572,791 | A | * | 3/1971 | Foley | 292/216 |
| 3,612,593 | A | * | 10/1971 | Bessette | 292/216 |
| 4,342,209 | A | * | 8/1982 | Kleefeldt | 70/264 |
| 4,518,180 | A | * | 5/1985 | Kleefeldt et al. | 292/201 |
| 4,518,182 | A | * | 5/1985 | Cousin et al. | 292/201 |
| 4,756,563 | A | * | 7/1988 | Garwood et al. | 292/216 |
| 4,978,154 | A | | 12/1990 | Kleefeldt | |
| 5,020,838 | A | * | 6/1991 | Fukomoto | 292/201 |
| 5,078,436 | A | * | 1/1992 | Kleefeldt et al. | 292/201 |
| 5,100,185 | A | * | 3/1992 | Menke et al. | 292/216 |
| 5,106,135 | A | * | 4/1992 | Menke et al. | 292/216 |
| 5,137,311 | A | * | 8/1992 | Brackmann | 292/216 |
| 5,273,325 | A | * | 12/1993 | Zimmermann | 292/216 |
| 5,419,597 | A | * | 5/1995 | Brackmann | 292/201 |
| 5,622,396 | A | * | 4/1997 | Neumann | 292/202 |
| 5,634,677 | A | * | 6/1997 | Büscher et al. | 292/216 |
| 5,685,579 | A | * | 11/1997 | Funk et al. | 292/216 |
| 5,765,884 | A | * | 6/1998 | Armbruster | 292/216 |
| 5,802,894 | A | * | 9/1998 | Jahrsetz et al. | 70/264 |
| 5,921,595 | A | * | 7/1999 | Brackmann et al. | 292/216 |
| 5,938,253 | A | * | 8/1999 | Szablewski et al. | 292/216 |
| 5,961,163 | A | * | 10/1999 | Brackmann | 292/201 |
| 6,076,868 | A | * | 6/2000 | Roger et al. | 292/201 |
| 6,338,508 | B1 | * | 1/2002 | Kleefeldt | 292/201 |

* cited by examiner

*Primary Examiner*—Teri Pham Luu
*Assistant Examiner*—Carlos Lugo
(74) *Attorney, Agent, or Firm*—Herbert Dubno; Andrew Wilford

(57) ABSTRACT

A motor-vehicle door latch has a latch element displaceable between a holding position bolt and a freeing position, and a pawl movable between a latched position retaining the latch element in the holding position and an unlatched position allowing the latch element to assume the freeing position. A release lever engageable with the pawl is movable between an actuated position displacing the pawl into the unlatched position and an unactuated position leaving the pawl in the latched position. A lock member has an abutment engageable in a locked position with the release lever for inhibiting movement of the release lever from the unactuated position into the actuated position and unengageable in an unlocked position with the release lever for permitting movement of the release lever from the unactuated position into the actuated position. An actuating lever coupled to the door handle is pivotal on actuation of a door unlocking member, e.g. an inside or outside handle. An elastically compressible link is engaged between the actuating lever and the release lever for, in the unlocked position of the lock means, transmitting movement from the actuating lever to the release lever and thereby permitting the actuating lever to operate the release lever and, in the locked position of the lock means, elastically deforming and permitting the actuating lever to move independently of the release lever and without displacing the release lever into the actuated position.

11 Claims, 12 Drawing Sheets

MOTOR-VEHICLE DOOR LATCH

FIELD OF THE INVENTION

The present invention relates to a motor-vehicle door latch. More particularly this invention concerns such a latch which can be locked and unlocked.

BACKGROUND OF THE INVENTION

A standard motor-vehicle door latch has a housing, a latch element displaceable in the housing between a position holding a bolt in the housing and a position freeing a bolt for movement into and out of the housing, and a pawl movable in the housing between a latched position retaining the latch element in the holding position and an unlatched position allowing the latch element to assume the freeing position. A release lever in the housing is engageable with the pawl and movable between an actuated position displacing the pawl into the unlatched position and an unactuated position leaving the pawl in the latched position. An actuating lever in the housing coupled to the door handle is pivotal on the housing on actuation of a door unlocking member. It is in turn operated at least by an outside handle and is coupled to the release lever so that the handle can operate the pawl through the actuating and release levers to unlatch the door.

There can be two actuating levers connected to respective inside and outside door handles and themselves connected together or operating a common actuating lever that in turn acts on the release lever. Furthermore the system is typically provided with a lock system that may be operated by a central-lock actuator, e.g. an electric motor, or by an inside lock button and/or an outside lock cylinder. In the standard system described in commonly owned U.S. Pat. No. 4,978,154 of Kleefeldt the lock system includes a member which can be shifted between a position coupling the actuating member(s) to the release lever and a position decoupling them. In the decoupled position actuation of the inside and/or outside door handle will be possible, but there will be no connection to the release lever so the actuation of the handle will not open the door. Such a system can also be provided with an antitheft position in which the inside lock button is also decoupled, making it impossible to unlock and unlatch the door from inside also.

A problem with this structure is that if the actuating lever is in its actuated position, the door cannot be unlocked. Thus merely holding out the outside door handle when the door is locked makes it impossible to unlock the door. Thus if the handle gets stuck in the out position, as for instance in an accident, the door will stay locked until it is moved back in. Otherwise operation of the latch functions while operating the lock members or vice versa can result in the mechanism locking up. This is particularly a problem with keyless entry systems where a person might be actuating a remote while another person is trying to op en a door. The door will not unlock until the person trying to open the door releases the handle and the person with the remote again actuates it to unlock the door.

OBJECTS OF THE INVENTION

It is therefore an object of the present invention to provide an improved motor-vehicle door latch.

Another object is the provision of such an improved motor-vehicle door latch which overcomes the above-given disadvantages, that is where actuation of the door handles does not interfere with the unlocking function.

SUMMARY OF THE INVENTION

A motor-vehicle door latch has according to the invention a housing, a latch element displaceable in the housing between a position holding a bolt in the housing and a position freeing a bolt for movement into and out of the housing, and a pawl movable in the housing between a latched position retaining the latch element in the holding position and an unlatched position allowing the latch element to assume the freeing position. A release lever in the housing engageable with the pawl is movable between an actuated position displacing the pawl into the unlatched position and an unactuated position leaving the pawl in the latched position. A lock member has an abutment in the housing engageable in a locked position with the release lever for inhibiting movement of the release lever from the unactuated position into the actuated position and unengageable in an unlocked position with the release lever for permitting movement of the release lever from the unactuated position into the actuated position. An actuating lever in the housing coupled to the door handle is pivotal on the housing on actuation of a door unlocking member, e.g. an inside or outside handle. An elastically compressible link in the housing is engaged between the actuating lever and the release lever for, in the unlocked position of the lock means, transmitting movement from the actuating lever to the release lever and thereby permitting the actuating lever to operate the release lever and, in the locked position of the lock means, elastically deforming and permitting the actuating lever to move independently of the release lever and without displacing the release lever into the actuated position.

Thus with this system the elastic link between the actuating lever and the release lever allows the lock member having the abutment to move even when the actuating member is in the actuated position. If a person pulls on a door handle and holds it out while another person actuates the unlock function of the remote, the door will open. Similarly if the remote is actuated to lock the door while the door handle is pulled out, once the handle is released, the door will be locked. In other words the elastic link will store up the force and use it to operate the release lever once it is unblocked.

Furthermore according to the invention a pivot carries the actuating lever and the link is a torque spring carried on the pivot. This torque spring has one leg engageable with the release lever and the link is in a path of the actuating lever. The spring is stiff enough that, when the release lever is not blocked, it can transmit sufficient force to the release lever to trip it and operate the pawl.

The abutment of the lock member has according to the invention a surface directly engageable with the release lever in the locked position. The actuating lever and release lever can be coaxially pivoted or mounted on separate parallel but offset pivots.

The release lever in accordance with the invention has an arm against which the one leg of the torque spring bears. The torque spring has another arm anchored to a body of the release lever. More particularly the release lever is L-shaped and has one arm engageable with the one leg of the torque spring and another arm engageable with the pawl. The one arm of the release lever is engageable radially of a pivot axis of the locking lever with the abutment.

The system of this invention can also have an inside actuating lever pivoted on the lock housing and a coupling lever pivoted on the locking lever and displaceable between a position coupling the inside lever to the pawl and a position decoupling the inside lever from the pawl. Thus the invention is perfectly applicable to a standard door lock with an inside handle, an outside handle, and inside locking element such as a button, an outside locking element such as a key cylinder, and a powered remotely controlled lock system.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
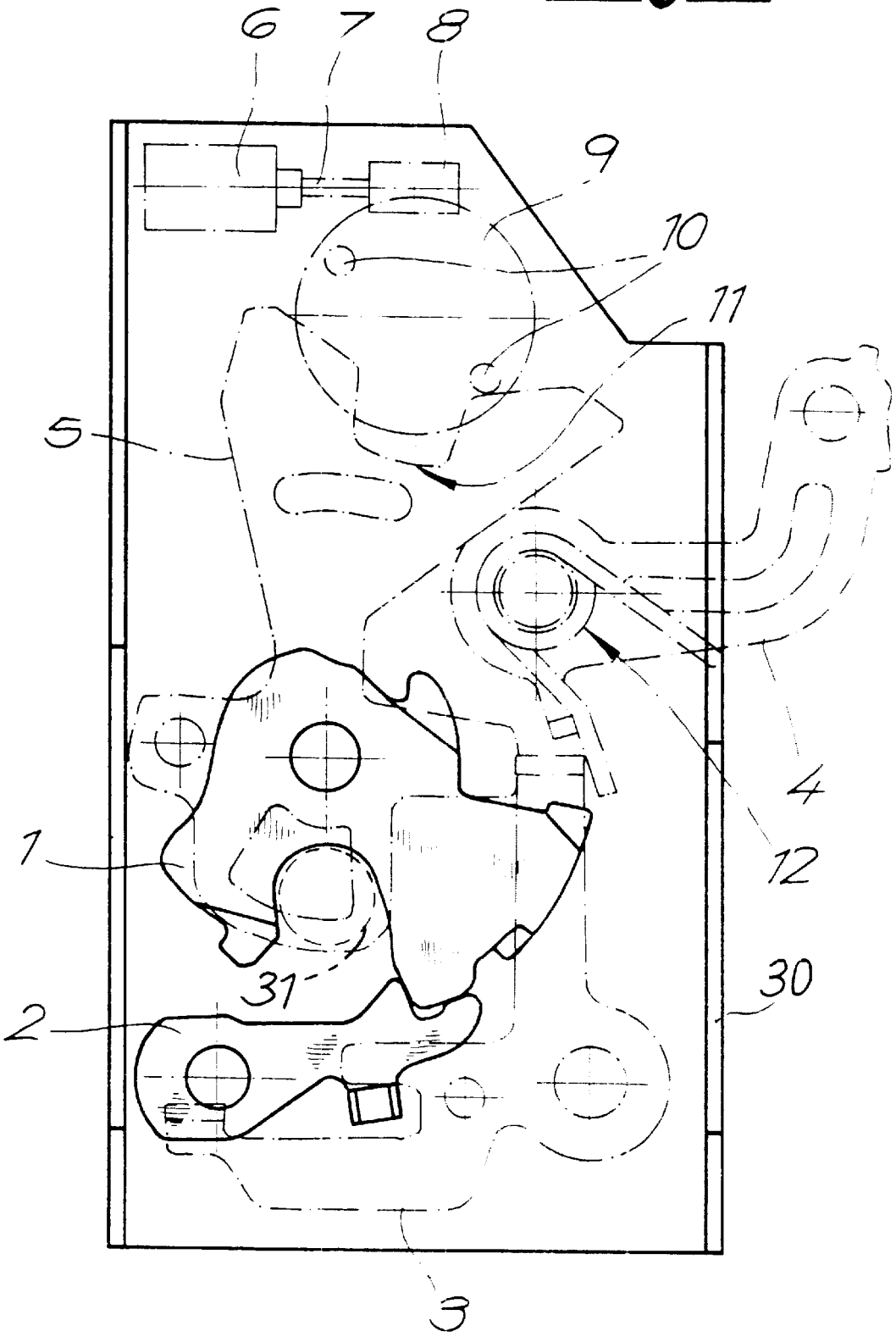
FIG. 1 is a side view of the latch according to the invention.

As seen in FIGS. 1 through 6 a motor-vehicle door latch in accordance with the invention has a housing 30 normally mounted on an unillustrated door edge and on which is pivoted a standard locking fork 1 engageable with a schematically illustrated bolt 31 mounted on an unillustrated door post. A pivotal pawl 2 of standard construction can be tipped by an actuating finger 18 of a release lever 3 between a position (FIGS. 1—4) retaining the fork 1 in a holding position capturing the bolt 31 in the housing 30 and a freeing position (FIG. 5) allowing the fork 1 to pivot and release the bolt 31.

The release lever 3 in turn is operated by an actuating lever 4 connected here to a diagrammatically illustrated outside door handle 32 (FIG. 3) and carried on a pivot 34. A torque spring 12 wound around the pivot 34 has one leg 14 bearing clockwise on and projecting radially past a tab 17 formed on the end of an arm 16 of the lever 4 and another leg 33 bearing against the body of the lever 4 and normally under prestress, although in theory this other leg 33 could also be anchored in the housing 30. The release lever 3 has an arm 35 formed with a bent-over end tab 15 that is engageable by the spring leg 14 where it projects past the end tab 17 of the arm 16 of the lever 4.

A locking lever 5 pivoted on the housing 30 is pivotal in a clockwise locking direction L and a counterclockwise unlocking direction UL by a reversible electric motor 6 mounted on this housing 30. An output shaft 7 of this motor 6 carries a worm gear 8 meshing with a toothed rim of a locking wheel 9 provided with diametrically opposite pins 10 engageable with opposite flanks of the notch 11. Thus the motor 6 can rotate the wheel 9 counterclockwise to shift the lever 5 clockwise in locking direction L and opposite motor rotation shifts it in the unlocking direction UL.

Figure 2:
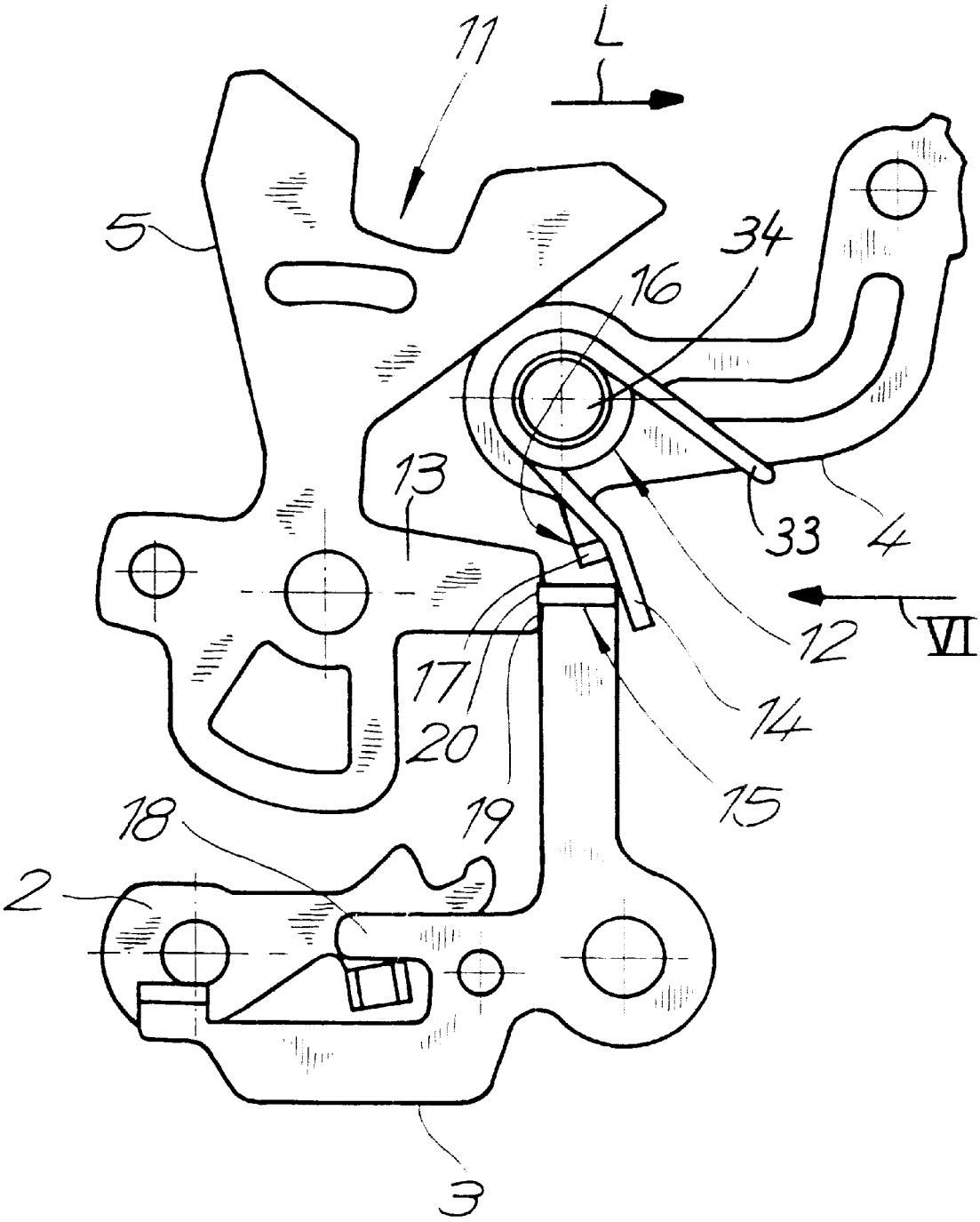
FIG. 2 is a view of the principal elements of the latch with the door closed and locked and the actuating lever unactuated.
Figure 3:
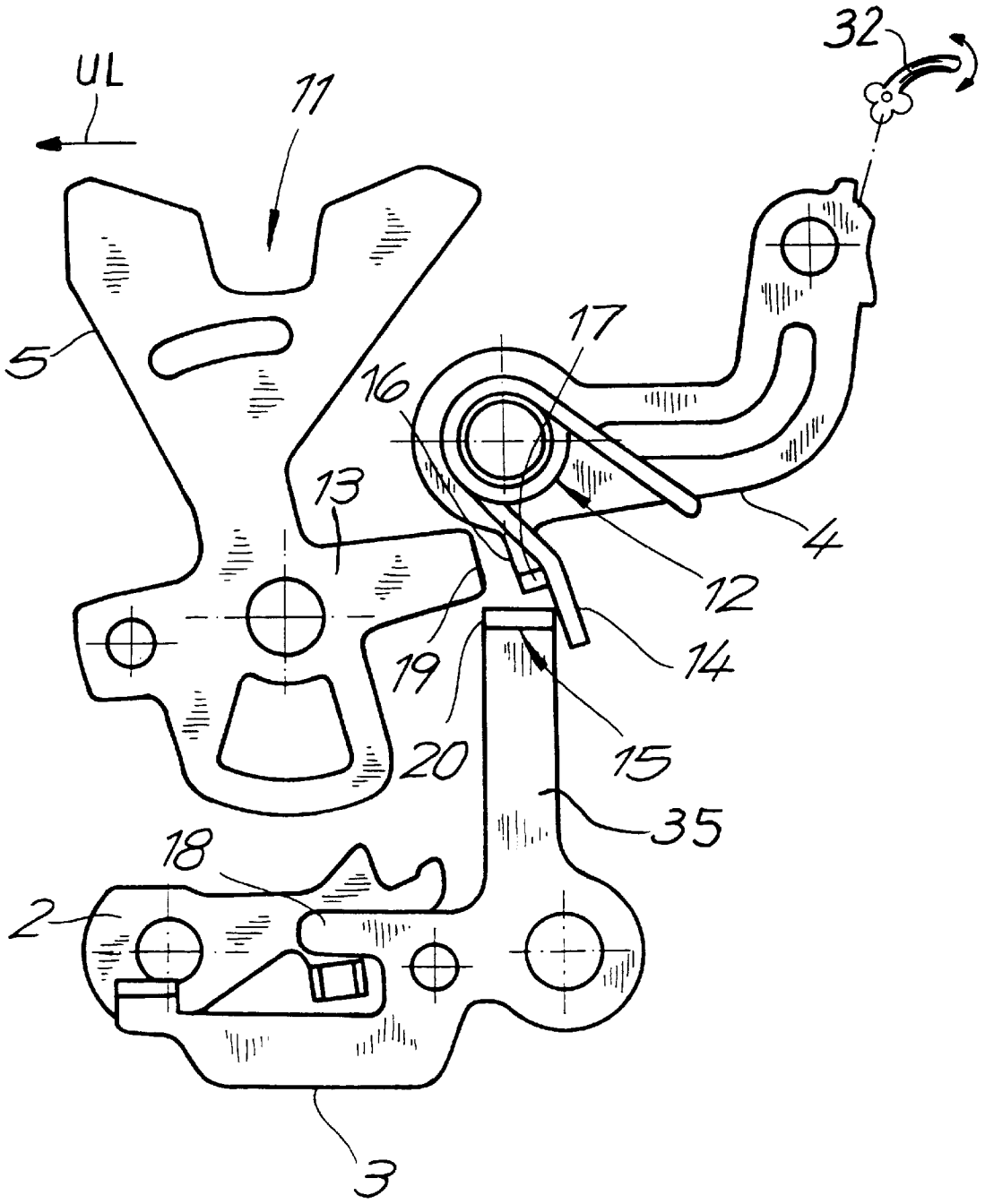
FIG. 3 is a view like FIG. 2 but with the door closed and unlocked and the actuating lever also unactuated.
Figure 4:
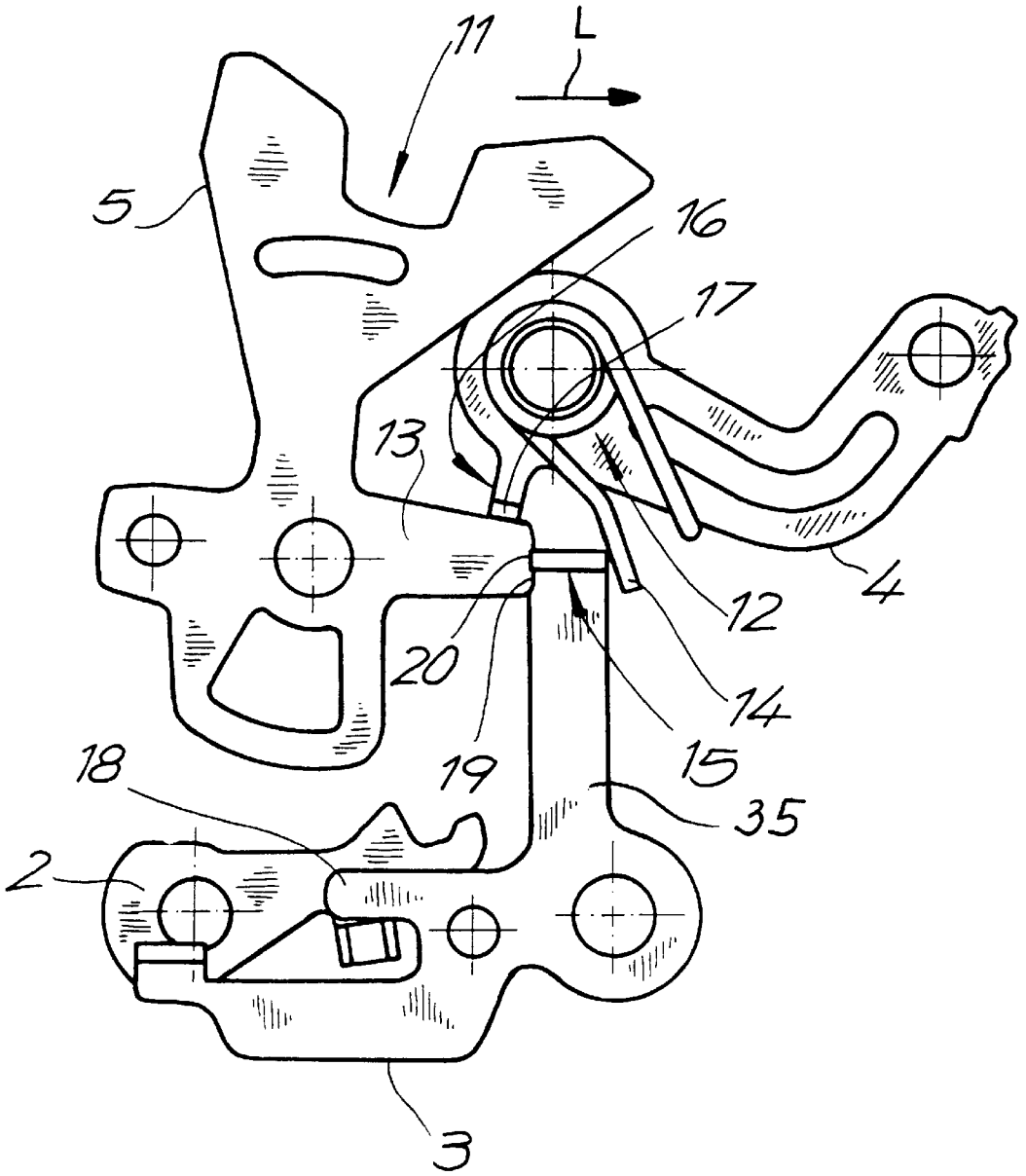
FIG. 4 is a view like FIG. 2 but with the door closed and locked and the actuating lever actuated.

The locking lever 5 has an arm 13 with an outer surface 19 engageable radially in a locked position shown in FIGS. 2 and 4 with an inner surface 20 of the end tab 15 of the arm 35 of the release lever 3. In an unlocked position shown in FIGS. 3 and 5 the surfaces 19 and 20 are unengageable with each other so pivoting of the actuating lever 4 is transmitted by the spring 12 to the release lever 3 to unlock the latch.

Figure 5:
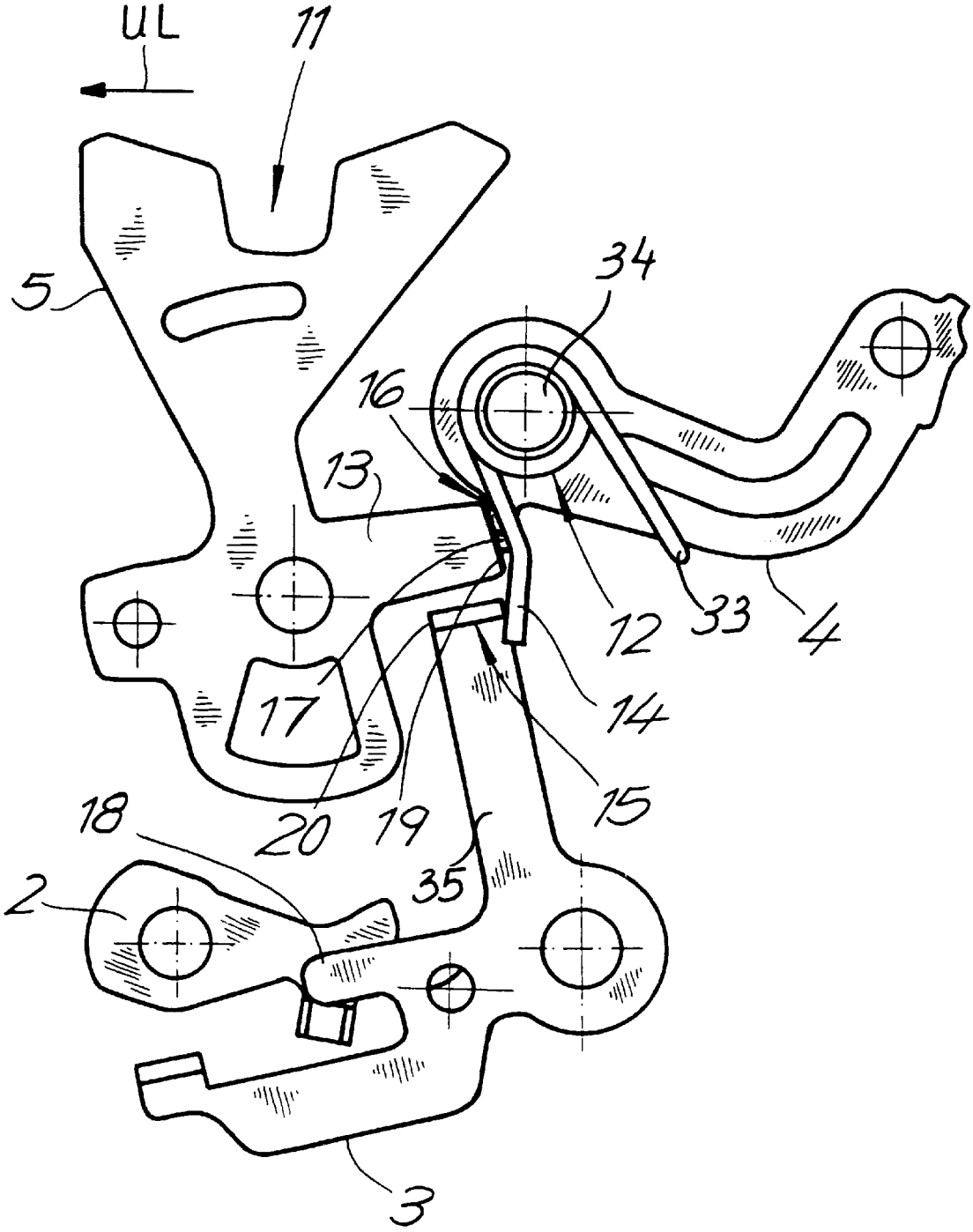
FIG. 5 is a view like FIG. 2 but with the door closed and unlocked and the actuating lever actuated.
Figure 6:
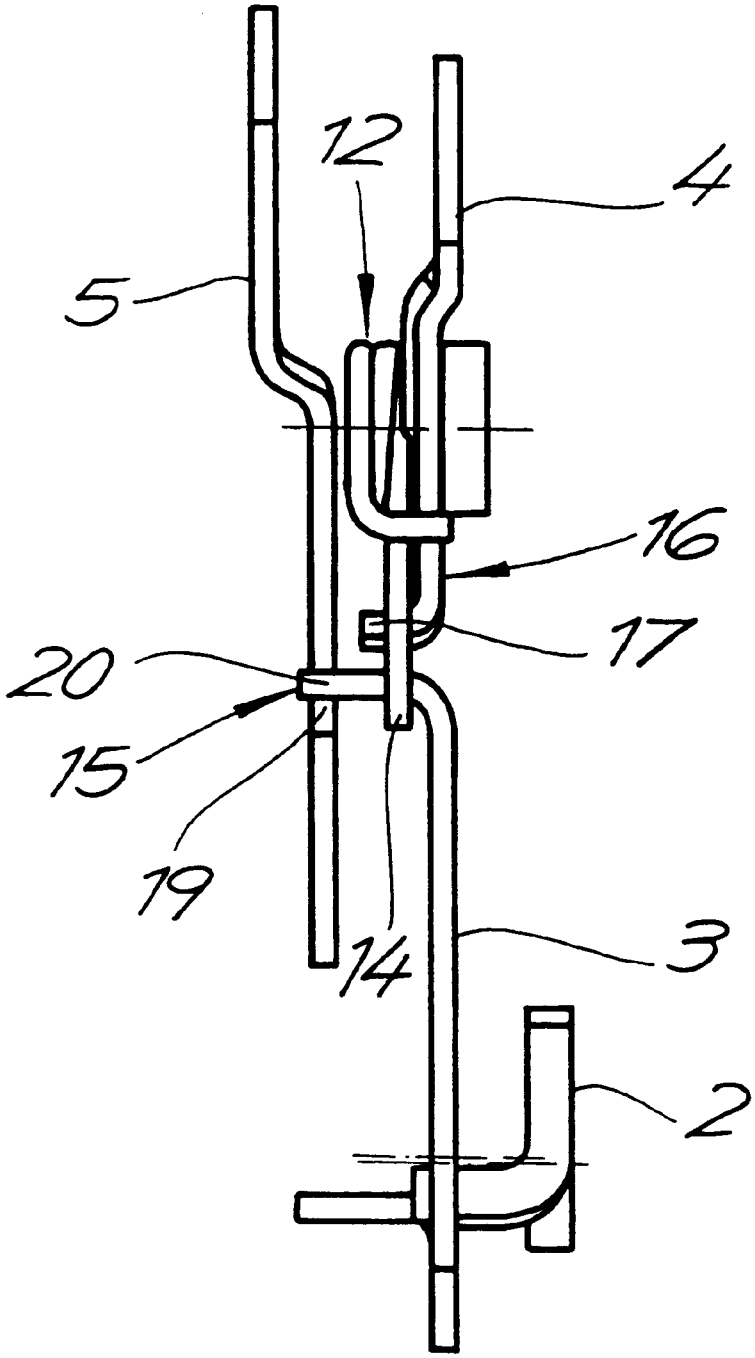
FIG. 6 is a side view taken in the direction of arrow VI of FIG. 2.

Thus with this system, where all the parts 1, 2, 3, 4, and 5 are pivoted about respective parallel axes offset from one another, the locking lever 5 can block pivoting of the release lever 3 by engagement of the surfaces 19 and 20 together. Even if the actuating lever 4 is operated in this locked condition as shown in FIG. 4 the spring 12 will simply deform as the lever 4 pivots, not moving the release lever 3. In the unlocked position of the lever 5 the surfaces 19 and 20 are not aligned with each other so that clockwise pivoting of the actuating lever 4 is transmitted by the spring leg 14 to the release lever 3, tripping it into the position actuating the pawl 2 as shown in FIG. 5 to allow the fork 1 to pivot and free the bolt 31.

Figure 7:
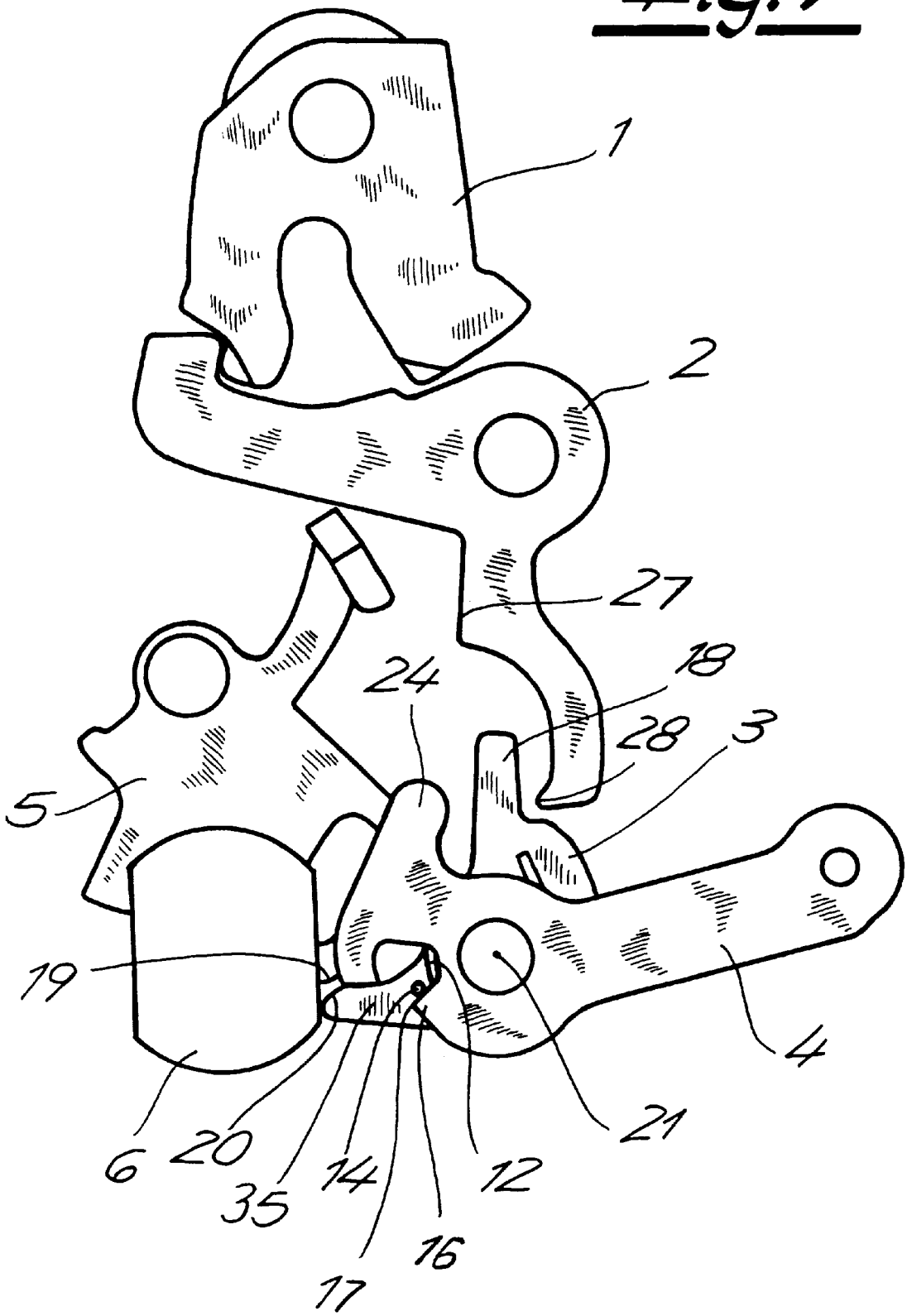
FIG. 7 is a view of the principal elements of another latch according to the invention with the door closed and locked and the actuating Diver unactuated.
Figure 8:
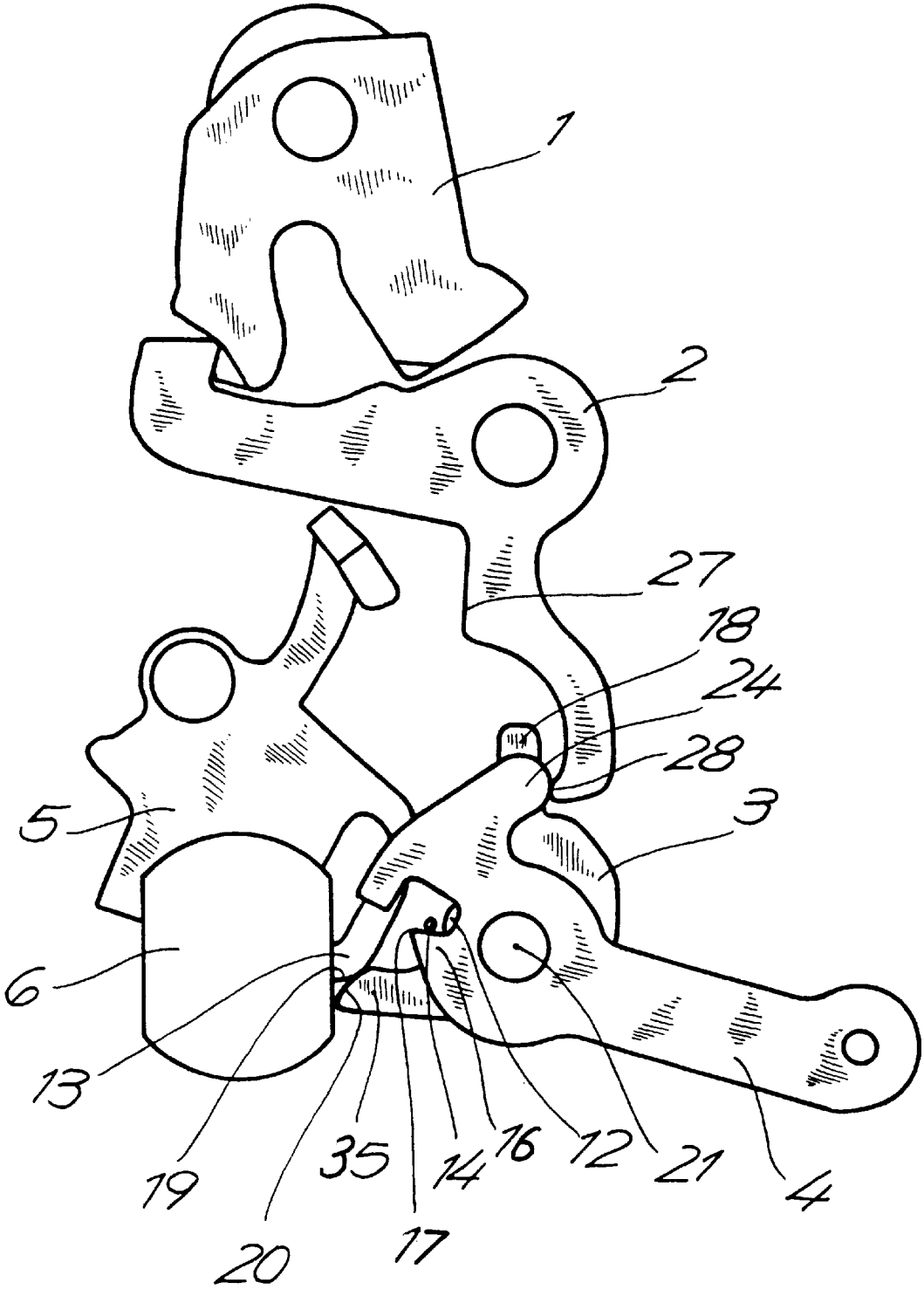
FIG. 8 is a view like FIG. 7 but with the actuating lever actuated.
Figure 9:
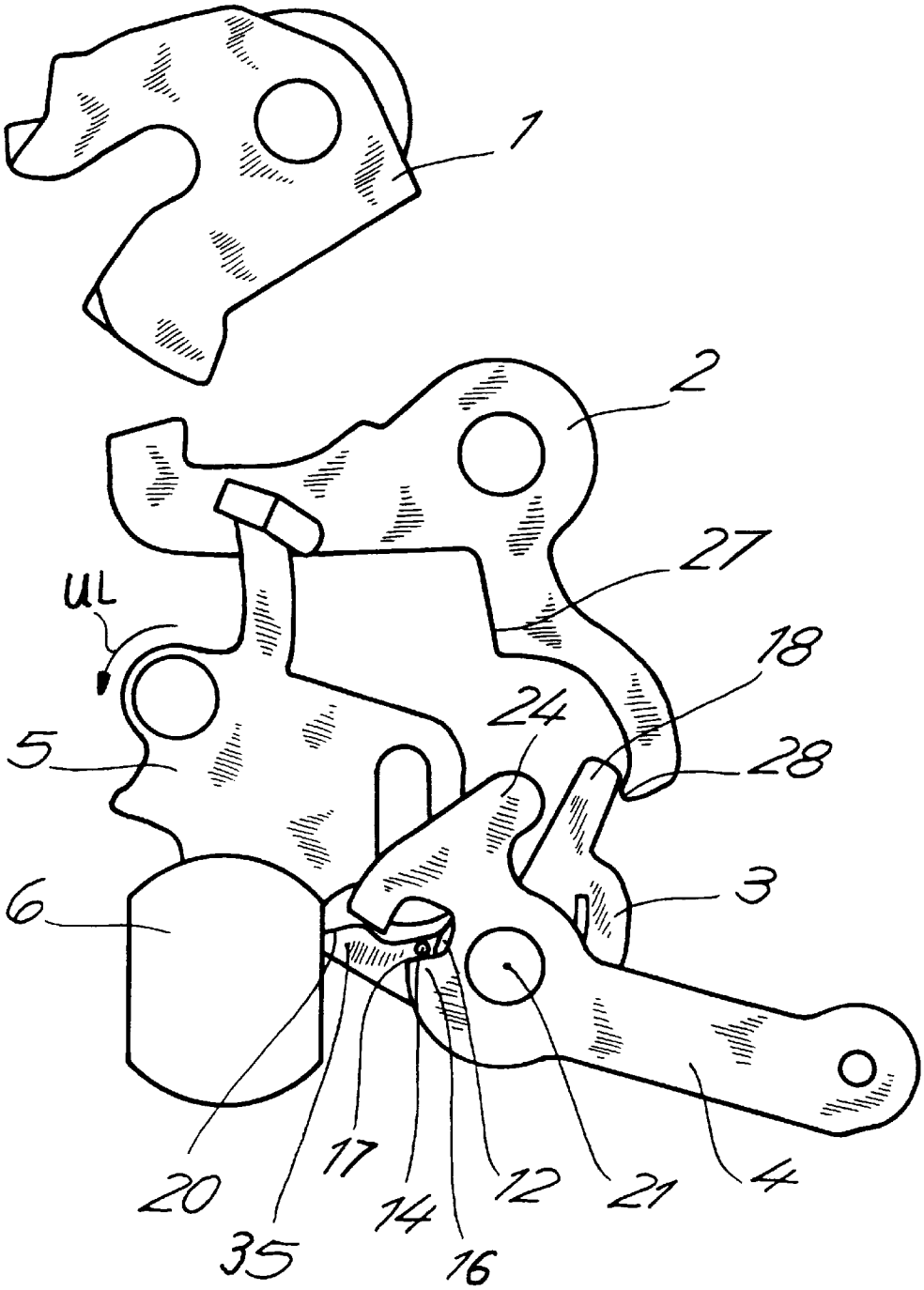
FIG. 9 is a view like FIG. 7 but with the door open and unlocked and actuating lever actuated.

In the arrangement of FIGS. 7 to 9 the release and actuating levers 3 and 4 are mounted on a common pivot 21 also carrying the spring 12 which itself is angularly braced between the levers 3 and 4 by having its one leg hooked over the end tab 17 and its other leg bearing on the arm 35 of the lever 3 and projecting therepast to engage the arm 16 of the lever 4. Thus when the locking lever 5 is in the locking position of FIGS. 7 and 8, pivoting of the lever 4 from the unactuated position of FIG. 7 to the actuated position of FIG. 8 will merely load the spring 12, since the surfaces 19 and 20 will engage each other and prevent pivoting of the release lever 3. When, however, the locking lever 5 is in the freeing position of FIG. 9, clockwise pivoting of the lever 4 will be transmitted by the spring 12 to the lever 3 which will press with its actuating finger 18 against a tip 28 of an arm 27 of the pawl 2.

Figure 10:
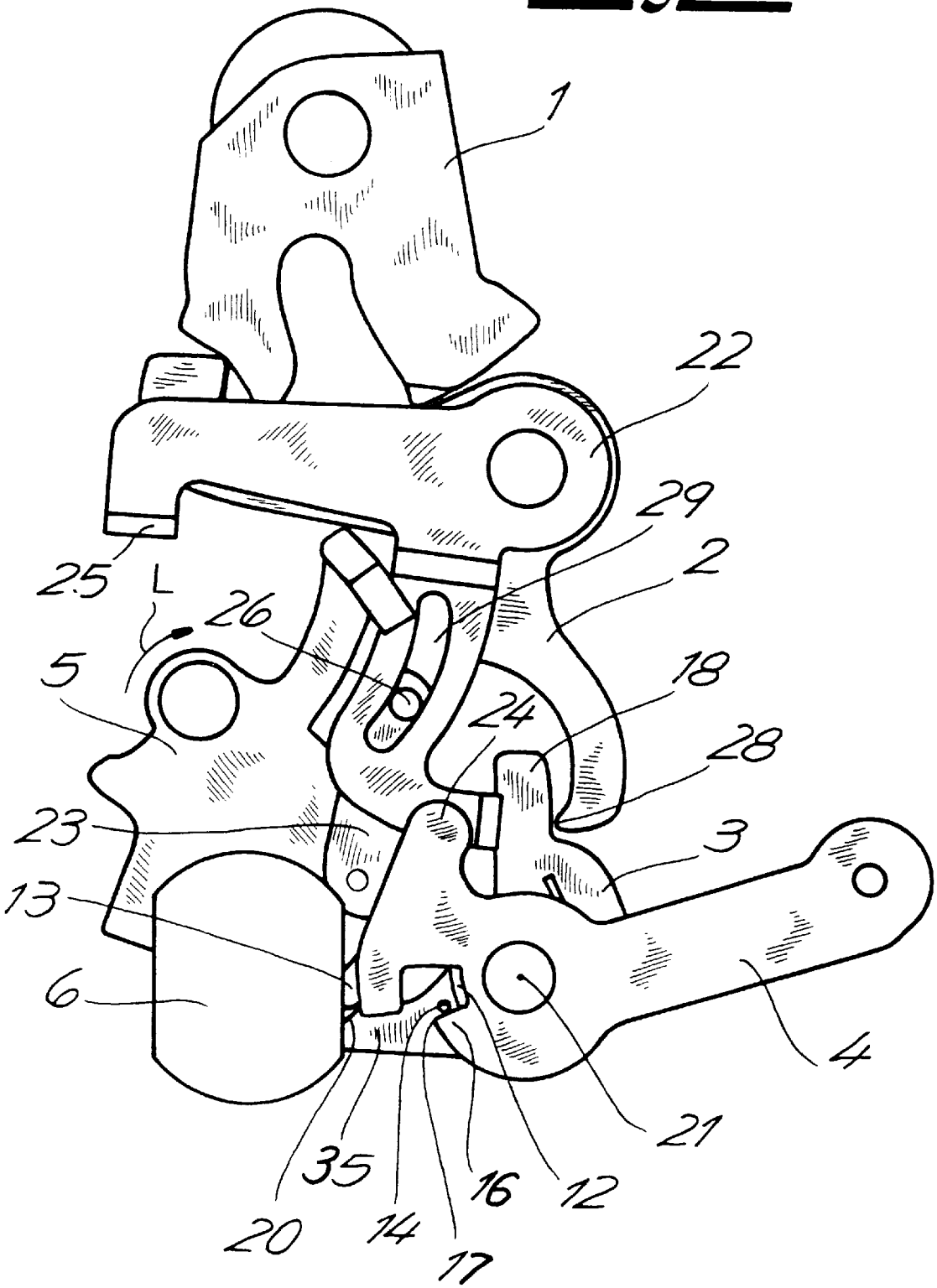
FIG. 10 is a view of the principal elements of yet another latch according to the invention with the door closed and locked and the actuating lever unactuated.
Figure 11:
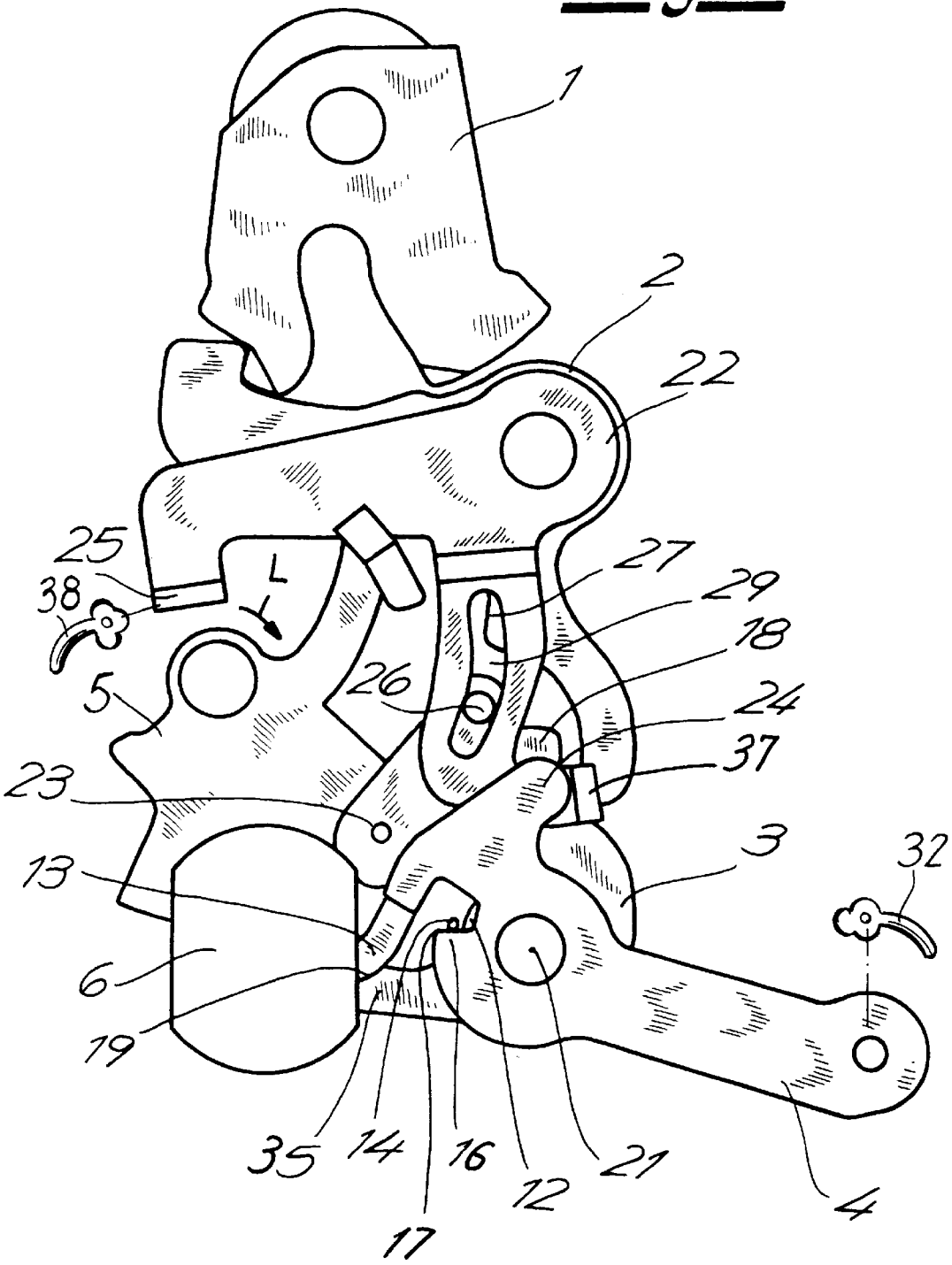
FIG. 11 is a view like FIG. 10 but with the actuating lever actuated.
Figure 12:
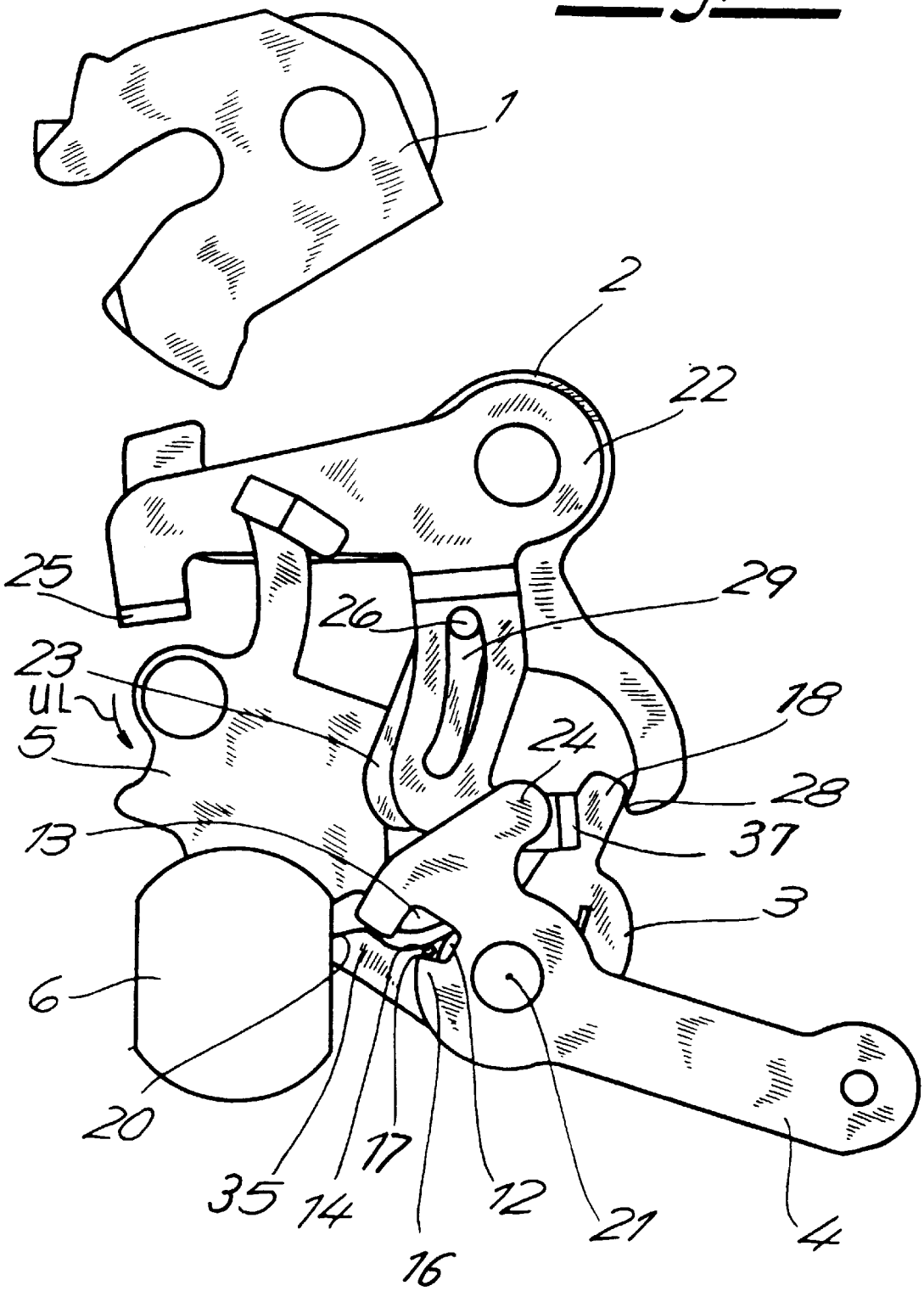
FIG. 12 is a view like FIG. 10 but with the door open and unlocked and the actuating lever actuated.

FIGS. 10, 11, and 13 show a system similar to that of FIGS. 7 to 9 with the addition of an inside actuating lever 22 pivoted coaxially with the pawl 2 and connected at an end tab 25 to an inside handle 38 and a coupling lever 23 pivoted on the locking lever 5. The inside actuating lever 22 has a bent-over end tab 37 engageable by a nose 24 of the outside actuating lever 4 so, whenever the actuating lever 4 is moved from the unactuated position (FIG. 10) to the actuated position (FIGS. 11 and 12), the inside handle also pivots.

The coupling lever 23 carries a pin 26 slidable in a slot 29 formed in the inside actuating lever 22. This pin 26 can move from a coupled position shown in FIG. 12 and engageable with a surface of the arm 27 of the pawl 2 and an uncoupled position shown in FIGS. 10 and 11 and clear of this surface of the arm 27. When the locking lever 5 is in the unlocked position (FIG. 12) so that the pin 26 is in the coupled position, counterclockwise pivoting of the lever 22, whether caused by actuation of the inside handle 38 or outside handle 32, will press the pin 26 against the surface of the arm 27 and cause the pawl 2 to pivot and release the fork 1. Similarly, clockwise rotation of the outside actuating lever 4 will be transmitted through the spring 12 to the release lever 3 and will press its actuating fingers 18 against the pawl tip 28 and pivot the pawl 2. Thus the inside handle 38 will be coupled to the pawl 2 through the lever 22, pin 26, and the surface of the arm 27 while the outside handle 32 will be coupled to the pawl 2 both through the lever 4, the nose 24, the tab 37, the lever 22, pin 26, and the surface of the arm 27 and through the spring 12, the release lever 3, the actuating finger 18, and the pawl tip 28.

When, however, the lock lever 5 is in the locked position as shown in FIGS. 10 and 11, pivoting of the inside lever 22 will be ineffective since the pin 26 will move clear of the surface of the arm 27 and not actuate the pawl 2. The inside lever 22 pivots counterclockwise independently of the lever 4 so such action has no effect on the rest of the mechanism. Similarly in the locked position of the lever 5 the surfaces 19 and 20 engage each other so that the lever 3 cannot pivot and its actuating finger 18 will not press the pawl tip 28 of the pawl 2, but instead the spring 12 will merely be tensioned. In this locked position the outside 1 ever 4 will be effective to pivot the inside lever 22, but since it is not coupled by the pin 26 to the pawl 2, such movement will have no effect.

I claim:

1. A motor-vehicle door latch comprising:

a housing;

a latch element displaceable in the housing between a position holding a bolt in the housing and a position freeing a bolt for movement into and out of the housing;

a pawl movable in the housing between a latched position retaining the latch element in the holding position and an unlatched position allowing the latch element to assume the freeing position;

a release lever in the housing engageable with the pawl and movable between an actuated position displacing the pawl into the unlatched position and an unactuated position leaving the pawl in the latched position;

lock means including an abutment in the housing engageable in a locked position with the release lever for inhibiting movement of the release lever from the unactuated position into the actuated position and unengageable in an unlocked position with the release lever for permitting movement of the release lever from the unactuated position into the actuated position;

an actuating lever in the housing coupled to the door handle and pivotal on the housing on actuation of a door unlocking member; and means including an elastically compressible link in the housing and engaged between the actuating lever and the release lever for, in the unlocked position of the lock means, transmitting movement from the actuating lever to the release lever and thereby permitting the actuating lever to operate the release lever and, in the locked position of the lock means, elastically deforming and permitting the actuating lever to move independently of the release lever and without displacing the release lever into the actuated position.

2. The motor-vehicle door latch defined in claim 1, further comprising a pivot carrying the actuating lever, the link being a torque spring carried on the pivot.

3. The motor-vehicle door latch defined in claim 2 wherein the torque spring has one leg engageable with the release lever.

4. The motor-vehicle door latch defined in claim 3 wherein the link is in a path of the actuating lever.

5. The motor-vehicle door latch defined in claim 3 wherein the abutment of the lock means has a surface directly engageable with the release lever in the locked position.

6. The motor-vehicle door latch defined in claim 3 wherein the actuating lever and release lever are coaxially pivoted.

7. The motor-vehicle door latch defined in claim 3 wherein the release lever has an arm against which the one leg of the torque spring bears.

8. The motor-vehicle door latch defined in claim 7 wherein the torque spring has another arm anchored to a body of the release lever.

9. The motor-vehicle door latch defined in claim 3 wherein the release lever is L-shaped and has one arm engageable with the one leg of the torque spring and another arm engageable with the pawl.

10. The motor-vehicle door latch defined in claim 9 wherein the one arm of the release lever is engageable radially of a pivot axis of the locking lever with the abutment.

11. The motor-vehicle door latch defined in claim 3, further comprising an inside actuating lever pivoted on the lock housing; and a coupling lever pivoted on the locking lever and displaceable between a position coupling the inside lever to the pawl and a position decoupling the inside lever from the pawl.

* * * * *